United States Patent [19]

Scalf

[11] Patent Number: 4,852,877

[45] Date of Patent: Aug. 1, 1989

[54] GOLF PUTTER

[76] Inventor: John H. Scalf, River St., Betsy Lane, Ky. 41605

[21] Appl. No.: 211,654

[22] Filed: Jun. 28, 1988

[51] Int. Cl.[4] ..... A63B 53/00

[52] U.S. Cl. ..... 273/77 R; 273/80 C; 273/164; 273/81.3

[58] Field of Search ..... 273/77 R, 77 A, 168, 273/81 D, 81.3, 80 C, 167 G, 164, 167 R, 167 D, 167 K

[56] References Cited

U.S. PATENT DOCUMENTS

| | | | |
|---|---|---|---|
| 1,486,823 | 3/1924 | Allen | 273/168 X |
| 2,843,384 | 7/1958 | Schmidt | 273/80 |
| 3,206,206 | 9/1965 | Santosuosso | 273/80.1 |
| 3,319,962 | 5/1967 | Summers | 273/164 |
| 3,394,937 | 7/1968 | Allport | 273/175 |
| 3,416,798 | 12/1968 | Pennington | 273/168 X |

FOREIGN PATENT DOCUMENTS

| | | | |
|---|---|---|---|
| 1459095 | 10/1966 | France | 273/168 |

*Primary Examiner*—George J. Marlo
*Attorney, Agent, or Firm*—Henderson & Sturm

[57] ABSTRACT

A golf putter construction (10) including a putter head member (13) having a vertical impact face (14) and an elongated shaft member (18) angularly disposed in an offset relationship in two distinct planes relative to the flat rear surface (16') of the putter head member (13) such that a golf ball (50) may be propelled towards a golf cup (51) in a shuffleboard fashion.

4 Claims, 1 Drawing Sheet

GOLF PUTTER

TECHNICAL FIELD

The present invention relates generally to a golf club, and in particular to a golf putter which allows the user to stand behind the golf ball.

BACKGROUND OF THE INVENTION

The present invention was the subject matter of DDP registration number 184141 which was filed in the U.S. Patent and Trademark Office on Jan. 11, 1988.

As can be seen by reference to the following U.S. Pat. No's: 3,394,937; 3,319,962; 3,206,206; and 2,843,384 the prior art is replete with myriad and diverse golf clubs which are designed for use on a putting surface.

While the prior art constructions are more than adequate for the purpose and function for which they were specifically designed, they do suffer from a number of shared deficiencies. For instance, when a conventional golf putter is used, there are multiple variables affecting the path of the golf ball, such as alignment of the golfer's shoulders and feet, as well as the speed and levelness of the putting stroke. These well recognized variables conspire to make putting one of the most challenging parts of the game of golf.

In addition, conventional putter require a golfer to stand parallel to the desired path of the golf ball, and this situation is not particularly advantageous due to the difficulty of aligning the predicted path of the ball from a position that requires that the golfer ignore the hole and concentrate only on the ball as the putting stroke is in progress.

Obviously, there has been a longstanding need for a golf putter construction which provides for increased accuracy and consistency. And the development of such a device is the stated purpose and objective of this invention.

BRIEF SUMMARY OF THE INVENTION

Briefly stated, the present invention comprises a unique alignment between the head of the putter and the shaft of the putter wherein the golfer is positioned behind the ball directly in line with the projected trajectory of the ball to the cup. In addition, this placement allows the golfer to keep both the ball and the cup in their line of sight right up until the moment of impact between the putter head and the golf ball.

In essence, the main distinctions between the putter construction of this invention and a conventional putter resides in the rearward angled disposition of the putter shaft relative to the vertical face of the putter head.

An appropriate analogy to the overall arrangement of this new putter construction would be to describe its shape as a modified shuffleboard stick, since the orientation of a shuffleboard player and a golfer employing the new putter construction would be closer to one another, than to the stance assumed by a golfer using a conventional putter.

BRIEF DESCRIPTION OF THE DRAWINGS

These and other objects, advantages, and novel features of the invention will become apparent from the detailed description of the best mode for carrying out the preferred embodiment of the invention which follows, particularly when considered in conjunction with the accompanying drawings, wherein.

BEST MODE FOR CARRYING OUT THE INVENTION

Figure 1:
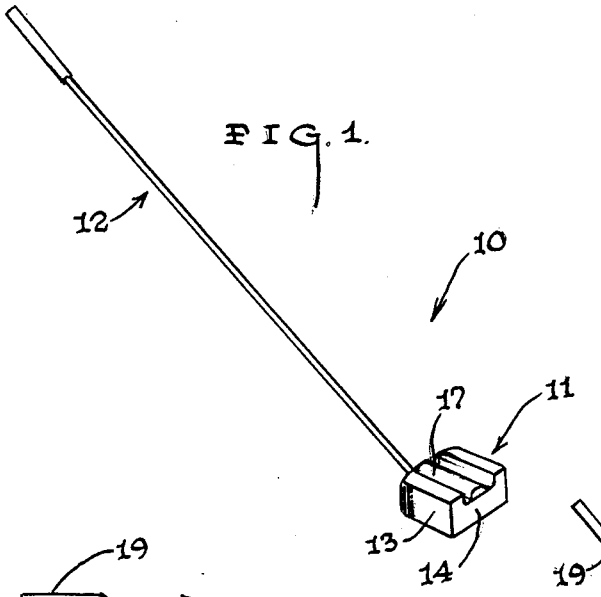
FIG. 1 is a perspective view of the golf putter construction of the invention.

As can be seen by reference to the drawings and in particular to FIG. 1, the golf putter construction that forms the basis of the present invention is designated generally by the reference numeral (10). The putter construction (10) comprises in general: a putter head unit (11) and a putter shaft unit (12). These units will now be described in seriatim fashion.

As shown in FIGS. 1 thru 5, the putter head unit (11) comprises a putter head member (13) having a vertical impact face (14), a generally flat recessed top surface (15), curved sides (16), and a flat rear surface (16') wherein the putter head member (13) has a generally rectangular configuration as viewed at ground level and a generally semi-circular configuration as viewed from above.

Figure 2:
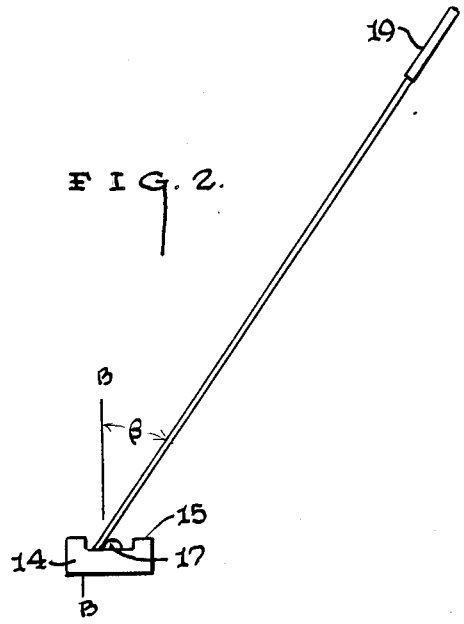
FIG. 2 is a front plan view.
Figure 4:
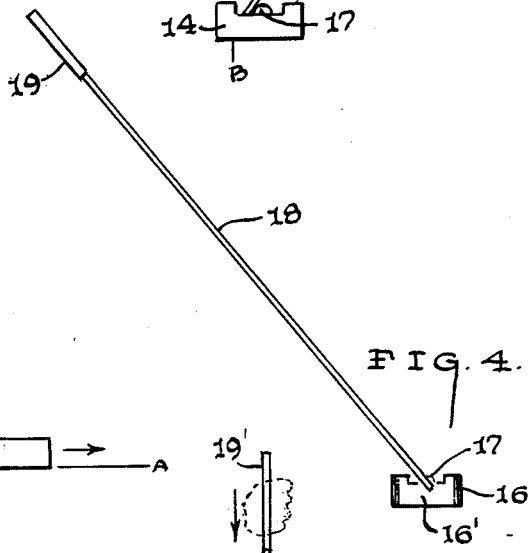
FIG. 4 is a rear plan view.
Figure 5:
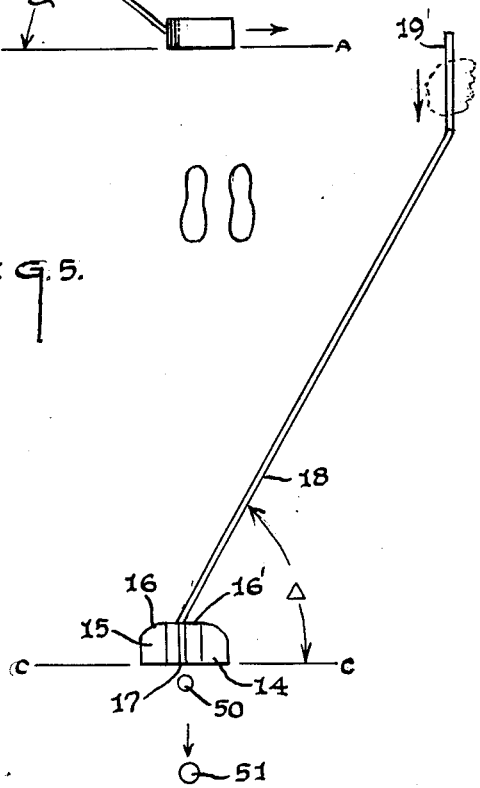
FIG. 5 is a top plan view.

As can best be seen by reference to FIGS. 2, 4, and 5, the recessed to surface (15) of the putter head member (14) is further provided with an elongated raised aiming reference element (17) that is centrally disposed on the top surface (15) and oriented perpendicular to the vertical impact face (14) of the putter head member (13).

Figure 3:
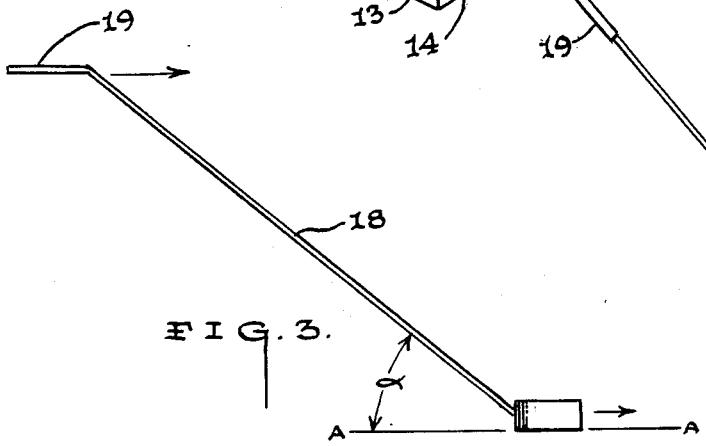
FIG. 3 is a side plan view.

Turning now particularly to FIGS. 3 and 4, it can be seen that the putter shaft unit (12) comprises an elongated shaft member (18) having a handle element (19) formed on one end; wherein, the other end (20) of the shaft member (18) is centrally secured to the generally flat rear surface (16') of the putter head member (13).

As can also be seen by reference to FIG. 3, the shaft member (18) is disposed at an angle of "$\alpha$" relative to a horizontal plane A—A extending through the putter head member (13); wherein, the value of "$\alpha$" is approximately equal to 45° C.

Turning now to FIGS. 2, 4, and 5, it can be seen that the shaft member (18) is disposed at an angle of "$\beta$" relative to a vertical plane B—B disposed perpendicular to a vertical plane C—C which is disposed parallel to the impact face (14) of the putter head member (13); wherein the value of "$\beta$" is less than 30°.

Still referring to FIGS. 2, 4, and 5, it can also be seen that the shaft member (18) is disposed at an angle of "$\Delta$" relative to the vertical plane C-C that is disposed parallel to the impact face (14) of the putter head member (13); wherein, the value of "$\Delta$" is less than 30°.

It should also be appreciated at this juncture that the drawings have been exaggerated regarding the angular disposition of the shaft member (18) relative to the putter head member (13) to emphasize the fact that the shaft member (18) does not have a conventional orientation with respect to the putter head member (13).

It should further be appreciated that the offset orientation of the shaft member (18) to the putter head member (13) is to allow a golfer to place the vertical impact surface (14) of the putter head member (13) perpendicular to the longitudinal alignment of the golfers feet (49) and the straight line path of travel between the golf ball (50) and the golf cup (51).

By virtue of the foregoing arrangement the golfer may position himself directly behind the golf ball (50) and in line with the golf cup (51) and by grasping the handle element (19) in one hand push the putter head member (13) parallel to the surface of the golf green in a shuffleboard fashion to propel the golf ball (50) towards the cup (51).

In an alternate version of the preferred embodiment depicted in FIGS. 3 and 5, the alternate handle element (19') of the shaft member (18) is disposed perpendicular to the vertical plane C—C that is parallel to the impact surface (14) of the putter head member (13), to facilitate the perpendicular alignment of the impact surface (14) relative to the projected line of travel of the golf ball (50) towards the golf cup (51).

Having thereby described the subject matter of this invention it should be obvious that many substitutions, modifications, and variations of the invention are possible in light of the above teachings. It is therefore to be understood that the invention as taught and described herein is only to be limited to the extent of the breadth and scope of the appended claims.

I claim:

1. A golf putter construction consisting of:

a putter head member including a straight vertical front impact fact; a generally flat top surface provided with a recess having a raised aiming reference element therein that is oriented perpendicular to the vertical front impact face; a generally flat bottom; two side surfaces and a rear face having a generally straight vertical portion; and, an elongated shaft member provided with a handle element on one end and fixedly connected on the other end to the rear surface of the putter head member; wherein, the shaft member is disposed at an angle "$\alpha$" relative to a horizontal plane passing through said putter head member; at an angle "$\Delta$" relative to the vertical impact surface of the putter head member; and, at an angle "$\beta$" relative to a vertical plane disposed perpendicular to the vertical impact surface of the putter head member; wherein, the handle element of said shaft member is disposed at an angle relative to said elongated shaft, and is disposed perpendicular to the vertical impact face of said putter head member.

2. The golf putter construction as in claim 1 wherein the value of the angle "$\alpha$" is approximately equal to 45°.

3. The golf putter construction as in claim 2 wherein the value of the angle "$\Delta$" is greater than 45°.

4. The golf putter construction as in claim 3 wherein the value of the angle "$\beta$" is less than 30°.

* * * * *